United States Patent [19]

Suzuki

[11] Patent Number: 4,461,096

[45] Date of Patent: Jul. 24, 1984

[54] DEHYDRATION APPARATUS

[75] Inventor: Tomosaburo Suzuki, Tsukui, Japan

[73] Assignee: Kabushiki Kaisha Daisei Kikai, Tokyo, Japan

[21] Appl. No.: 354,350

[22] Filed: Mar. 3, 1982

[30] Foreign Application Priority Data

Aug. 29, 1981 [JP] Japan ..... 56-135796

[51] Int. Cl.[3] ..... F26B 11/08

[52] U.S. Cl. ..... 34/56; 34/58; 68/210

[58] Field of Search ..... 34/56, 58, 172; 68/210; 222/502, 503, 507

[56] References Cited

U.S. PATENT DOCUMENTS 3,413,729 12/1968 Wagner ..... 34/58

3,570,135 3/1971 Rousselet ..... 34/58

*Primary Examiner*—Larry I. Schwartz

*Assistant Examiner*—David W. Westphal

*Attorney, Agent, or Firm*—Oblon, Fisher, Spivak, McClelland & Maier

[57] ABSTRACT

A dehydration apparatus for separating water deposited on articles charged in a dehydrating vessel by centrifugal force resulting from rotation, in which the bottom plate of said dehydrating vessel is constructed so as to be openable such that the articles in the dehydrating vessel are caused to drop down by opening said bottom plate and can be easily taken out.

2 Claims, 11 Drawing Figures

DEHYDRATION APPARATUS

BACKGROUND OF THE INVENTION

1. Field of the Invention

The present invention relates to a dehydration apparatus utilizing centrifugal force, and particularly to a dehydration apparatus so constructed that it is facilitated to take out dehydrated materials from a dehydrating vessel, after dehydration. When bean sprouts, cut vegetables or the likes which have been harvested and washed with water are packed into bags and set out, it is required to carry out dehydrating operation for these bean sprouts and cut vegetables.

The present invention is intended to provide a dehydration apparatus particularly adapted to carry out such dehydrating operation.

2. Description of the Prior Art

Conventional dehydration apparatuses have been of the type such that a dehydrating vessel is constructed so as to be able to tilt around pivotal secured point or capable of being upwardly hung out, wherein after dehydrating operation due to completion of the application of centrifugal force, dehydrated materials are taken out of the dehydrating vessel by turning the dehydrating vessel aroun pivoted secured point or hanging it up and taking out the dehydrating vessel by a crane.

Accordingly, in such kinds of conventional dehydration apparatuses there are drawbacks such as the complexity of the structure for making a dehydrating vessel imparted with centrifugal force to be able to tilt or the requirement of such installations as a crane or the like for hanging up the dehydrating vessel, with corresponding difficulty in its operation and inefficiency in dehydrating operation occurring.

SUMMARY OF THE INVENTION

Accordingly, it is an object of the present invention to provide a dehydration apparatus wherein the drawbacks of such conventional apparatuses are eliminated.

It is a further object of the present invention to provide a dehydration apparatus in which the bottom plate of a dehydrating vessel is constructed so as to be rotatable together with the dehydrating vessel, wherein the bottom plate is opened by utilizing its rotating motion.

It is an additional object of the present invention to provide a dehydration apparatus in which the bottom plate of a dehydrating plate is constructed so as to not be rotated, wherein the operation of opening and closing the bottom plate is facilitated.

It is still further object of the present invention to provide a dehydration apparatus in which the bottom plate is openable by remote operation.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
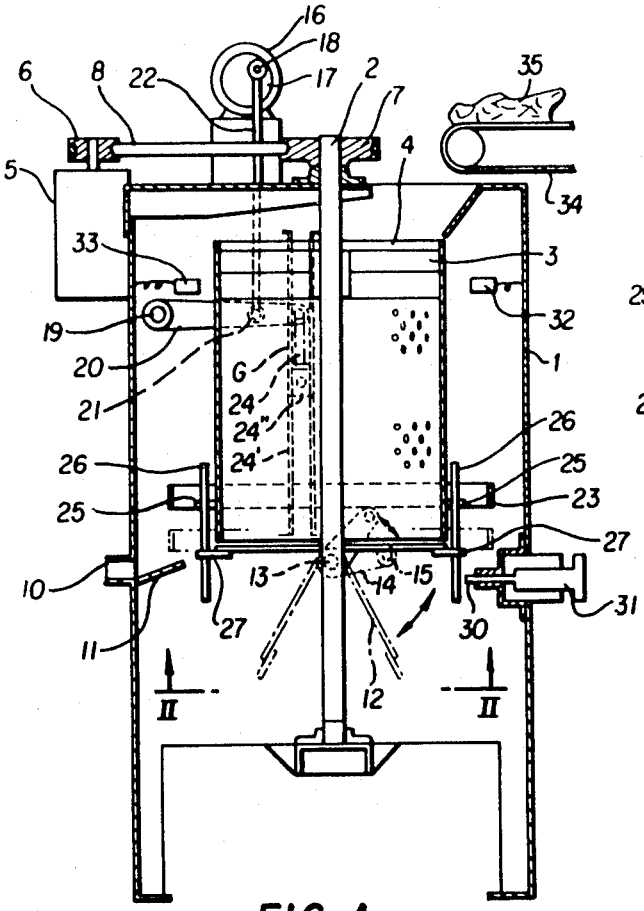
FIG. 1 is a longitudinal sectional view showing a dehydration apparatus according to one embodiment of the present invention.

In FIG. 1 reference numeral 1 represents a machine body of a dehydration apparatus in which a rotatable rotary shaft 2 is vertically supported at the center of machine body 1. A cylindrical dehydrating vessel 4 is mounted on the rotary shaft 2 via ribs 3. The dehydrating vessel 4 includes a perforated plate for dehydration. A variable-speed motor 5 is mounted on the outside of the machine body 1, and a belt 8 is stretched between a pulley 6 fitted on the rotary shaft of motor 5 and a pulley 7 fitted on the rotary shaft 2 of the dehydrating vessel 4 so that the dehydrating vessel 4 can be rotated by rotation of the motor 5.

The machine body 1 has a drain hole 10 provided therein and a circular ring-shaped aqueduct 11 is provided in the interior thereof, whereby water is displaced out of the dehydrating vessel 4 by centrifugal force, is lowered along the inner wall of the machine body 1 and is collected and discharged.

Figure 2:
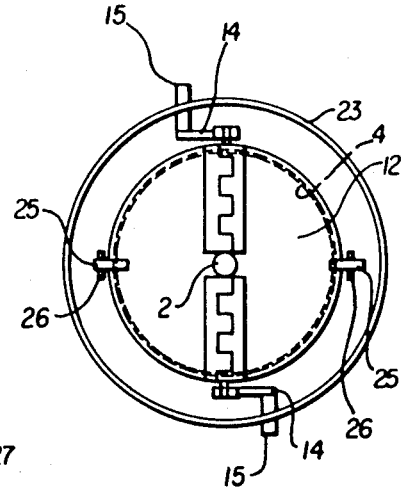
FIG. 2 is a plan view taken along line II—II of FIG. 1.

A bottom plate 12 of the dehydrating vessel 4 is divided into first and second parts in semicircular form, as shown in FIG. 2, and can be opened, with its axis 13 as a center, with their circumferential parts suspended as shown by a broken line in FIG. 1. The semicircular parts of the bottom plate 12 each have a lever 14 disposed thereon, and a contact piece 15 is fitted on each of these levers 14. As shown by the broken line in FIG. 1, the levers 14 also move as one body in accordance with the movement of the bottom plate 12.

A geared motor 16 is mounted on the top part of the machine body 1 and a crank disc 17 is fitted on the rotary shaft thereof. The crank disc 17 has a crank pin 18 fitted thereon. The machine body 1 has a lever 20 pivotally secured at a lever support 19 and a pin 21 provided on lever 20, and a link 22 is furnished between the crank pin 18 and the pin 21.

A bottom plate-opening and closing ring 23 is arranged on the outside of the dehydrating vessel 4, and the lever 20 and the ring 23 are connected with each other by links 24,24'. Connection of the links 24,24' is accomplished by way of a slide piece 24" that slides along a guide groove G properly provided on the inner wall of the machine body 1.

When the geared motor 16 is rotated so as to rotate the crank disc 17, accordingly, the link 22 is displaced with the movement of the crank pin 18 so that the lever 20 is turned and, as a result, the links 24,24' are displaced to move up the ring 23 in the vertical direction. After the ring 23 is made to rise, ring 23 permits the contact piece 15 to turn upwardly so that the bottom plate 12 is opened, as shown by the broken line of FIG. 1. When ring 23 is lowered, on the other hand, contact piece 15 is pushed downwardly so that the bottom plate 12 is brought to a closed state.

Figure 3:
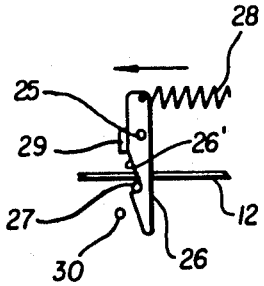
FIGS. 3 to 5 are each an enlarged side view illustrating the work of a hook that is utilized in the embodiment of FIG. 1 and FIG. 2.
Figure 4:
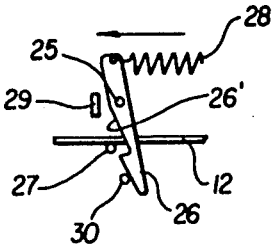

As shown in FIG. 3 and FIG. 4, a hook 26 is pivotally secured on the outer circumference of the lower part of the dehydrating vessel 4 by a pin 25, and the hook 26 has an engagement groove 26' formed therein. On the bottom plate 12, on the other hand, there is fitted an engagement member 27 which is engaged with the engagement groove 26' of the hook 26 to maintain the bottom plate 12 in a closed position. The upper end part of the hook 26 is biased by a draft spring 28 to thereby maintain such state that engagement member 27 is engaged with the engagement groove 26' or the bottom plate 12 is closed.

Reference numeral 29 denotes a stopper for restricting the movement of the hook 26 by the spring 28. Machine body 1 is furthermore provided with a solenoid 31 for positioning a projectile bar 30 into or out of the machine body 1 as shown in FIG. 1. When projectile bar 30 protrudes into the machine body by solenoid 31 it contacts with the hook 26 pivotally secured on the outer circumference of the rotating dehydrating vessel 4 and turns the hook 26 around the pin 25 against the tensile force of the spring 28, from the state of FIG. 3 to the state of FIG. 4. Accordingly, member 27 of the bottom plate 12 is released from the engagement groove 26' of the hook so that the bottom plate 12 is opened, as shown by the broken line of FIG. 1.

Figure 5:
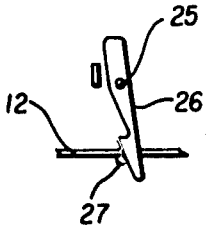

By rotating the geared motor 16 to make the ring 23 be lowered in the state the bottom plate 12 is closed as mentioned above. With the turning of the bottom plate 12, at such time, engagement member 27 is displaced for opening the hook 26 as shown in FIG. 5, and the engagement member 27 engages engagement groove 26' of the hook 26 so as to be maintained in closed state.

In the drawings, reference numeral 32 denotes a photoelectric tube for detecting the charge level of materials to be dehydrated within the dehydrating vessel 4 and reference number 33 indicates a light projector. Reference numeral 34 denotes a belt conveyor for transferring the materials 35 to be dehydrated into the dehydrating vessel 4.

Figure 6A:
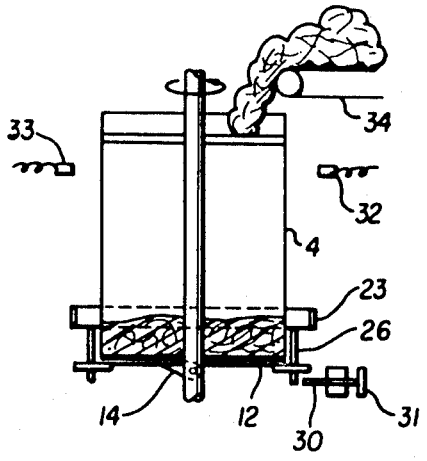
FIGS. 6A-6D are perspective views illustrating the work of the apparatus shown in FIG. 1.
Figure 6B:
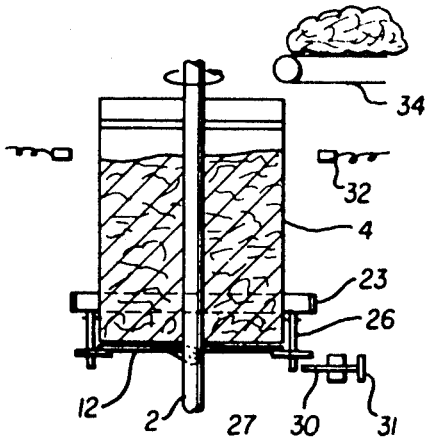

Operation of the above-mentioned apparatus will now be described here by reference to FIGS. 6A–6D. As shown in FIG. 6A, materials 35 to be dehydrated are transferred from the conveyor 34 into the dehydrating vessel 4 with the bottom plate 12 closed, and when the level of the charged materials reaches a predetermined height, the conveyor 34 is stopped and the dehydrating vessel 4 is rotated as shown in FIG. 6B. By rotation of the dehydrating vessel 4, the materials to be dehydrated therein are dehydrated by centrifugal force.

Figure 6C:
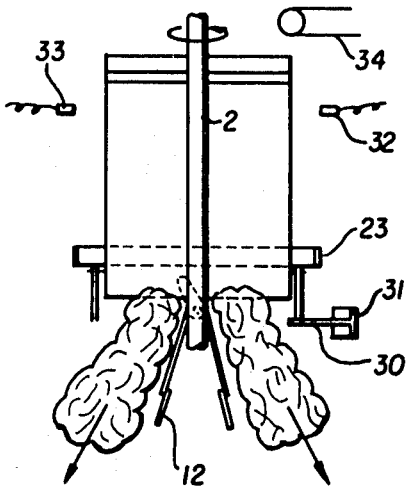

When dehydration is completed after a predetermined period of rotation, the dehydrating vessel 4 is brought into low-speed rotation and the solenoid 31 is operated so that the projectile bar 30 is made to protrude inwardly. Accordingly, the projectile bar 30 is contacted with the lower end part of the hook 26 pivotally secured on the outside of the dehydrating vessel 4, whereby the engagement member 27 of the bottom plate 12 is released out of engagement groove 26' of the hook 26, and the bottom plate 12 of the dehydrating vessel 4 is then opened as shown in FIG. 6C, and the dehydrated materials are made to drop so as to be discharged. At that time, the ring 23 is in an upwardly shifted state so that the contact piece 15 of the lever 14 is not brought into contact with the turning of the bottom plate 12.

Figure 6D:
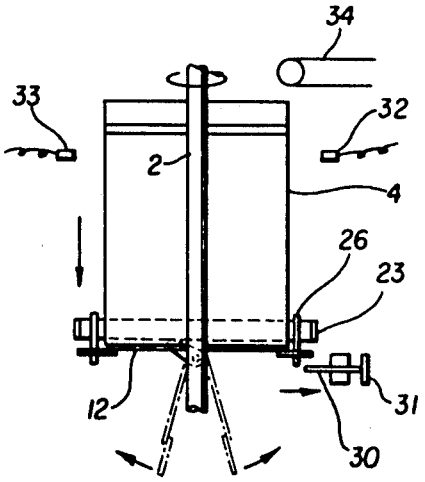

When discharge of the dehydrated materials is completed, ring 23 is lowered by rotation of the geared motor 16, and the contact piece 15 of the lever 14 is pushed downardly so as to move the bottom plate 12 in the closing direction, as shown in FIG. 6D. At that time, the solenoid makes the projectile bar 30 retract, and, as shown in FIG. 5, the engagement member 27 of the bottom plate 12 is raised, with pushing and expansion of the hook 26, and engages with engagement groove 26' of the hook 26, so that the bottom plate 12 is maintained in a closed position. Under such condition, dehydrating operation is again returned to the state of FIG. 6A.

In addition, the bottom plate 12 adapted in the above-mentioned embodiment is of the type including a first and second semicircular divided parts, and this is, of course, only one example. A bottom plate may be so constructed as to be openable, with its one end pivotally secured insofar as it is a circular plate.

The assembly which includes the hook 26 hooking the bottom plate, the solenoid 31 for engaging or releasing hook 26, the ring 23 closing the bottom plate and the like, is merely one exemplary embodiment. It is needless to say that another suitable embodiment may be adapted, if it is such a construction that the bottom plate 12 is maintained in a closed state, and opened for a desired length of time.

Figure 7:
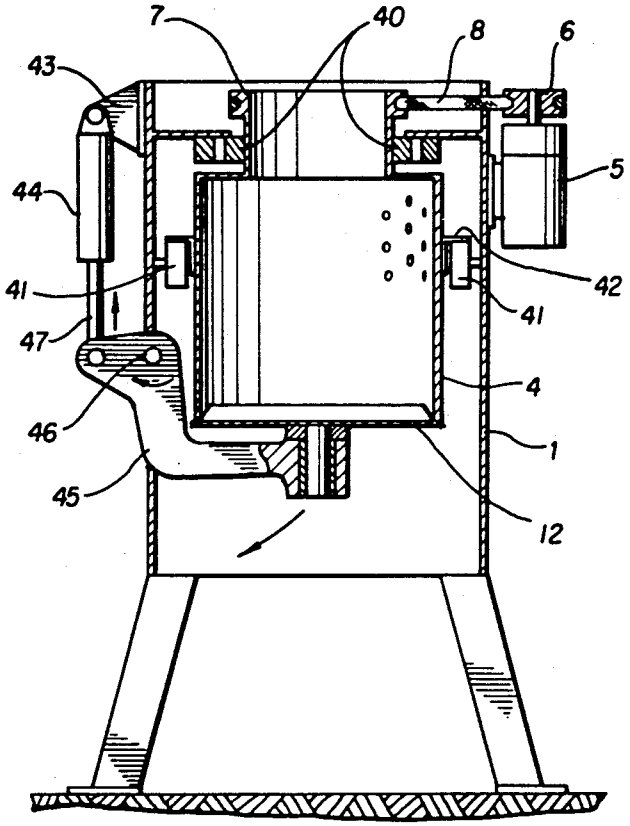

A second embodiment as shown in FIG. 7 will be described hereinbelow. In FIG. 7, portions designated by the same numerals as FIG. 1 are the same or similar portions as described in accordance with FIG. 1. A dehydrating vessel 4 is rotatably supported in a machine body 1 by a plurality of rollers 40, 41 rotatably supported in the machine body. Roller 41 is adapted to receive a circular ring 42 secured on the dehydrating vessel 4 and supports the weight of the dehydrating vessel 4. The dehydrating vessel 4 thus supported is driven for rotation by a variable-speed motor 5, pulleys 6, 7 and a belt 8.

Machine body 1 has a hydraulic cylinder 44 pivotally secured thereon by way of a bracket 43. A lever 45 is pivotally secured as denoted by reference number 46 on the machine body 1, and one end of lever 45 and a piston 47 of the hydraulic cylinder 44 are connected with each other, as shown in FIG. 7. The bottom plate of the dehydrating vessel 4 is rotatably supported on the other end of the lever 45.

In the dehydration apparatus shown in FIG. 7, the dehydrating vessel 4 and bottom plate 12 are rotated by the power supplied from the motor 5 in the illustrated state, and when dehydrating operation is completed, the hydraulic cylinder 44 is retracted and the lever 45 is turned around the pivotal secured point 46 in the direction of the illustrated arrow, the bottom plate 12 is then turned for opening in the direction of the arrow, and articles thus dehydrated are then discharged.

Figure 8:
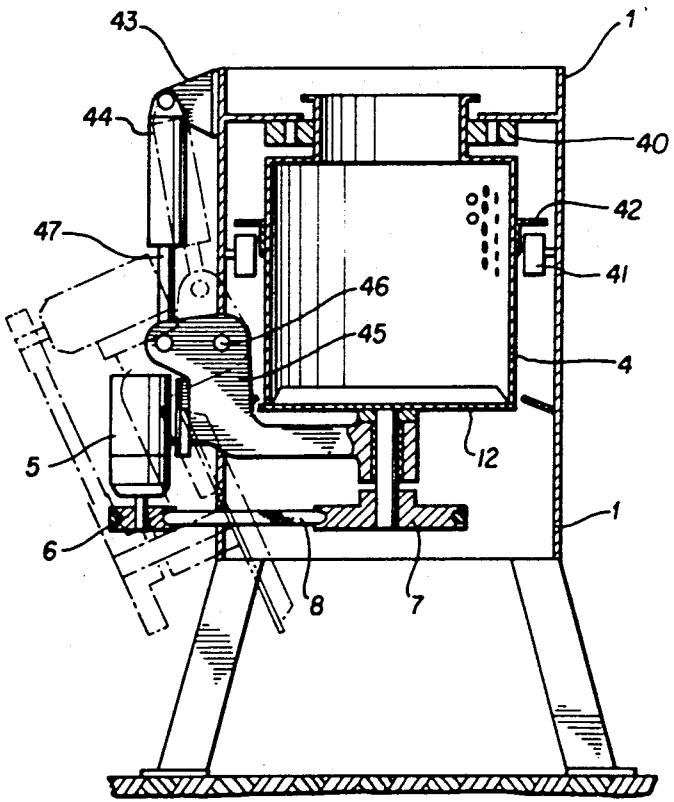
FIG. 7 and FIG. 8 are each longitudinal sectional views showing a second embodiment, similar to that of FIG. 1.

In the embodiment shown in FIG. 8, a variable-speed motor 5 is mounted on a lever 45 and a pulley 7 is fitted on a shaft for rotating a bottom plate, differently from the embodiment shown in FIG. 7. Accordingly, when hydraulic cylinder 44 is made to retract in the apparatus shown in FIG. 8, the motor 5 that is a driving source for rotating a dehydrating vessel 4 and the like are also turned as one body with the bottom plate 12, as shown by the broken line of FIG. 8.

Since the present invention, as described in the foregoing discussion, provides for a dehydration apparatus in which the bottom plate of a dehydrating vessel is so constructed as to be openable, dehydrated materials can be discharged, without hanging up or tilting the dehydrating vessel.

This discharging operation is, furthermore, easy to automate because it can be carried out only by opening and closing the bottom plate of the dehydrating vessel, and thus the corresponding loss in time and power due to the start-up and stopping of the apparatus is advantageously minimized because the opening and closing of the bottom plate can be carried out as the dehydrating vessel is rotating.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A dehydration apparatus for dehydrating materials, comprising:

a dehydrating vessel having a bottom plate;

means for rotating said vessel;

means for opening said bottom plate and discharging dehydrated materials from said vessel;

hook means mounted on said dehydrating vessel for maintaining said bottom plate in a closed position and at least one projectile bar for axial movement toward and away from said hook means, said projectile bar being movable into engagement at the end of the dehydrating cycle to disengage the hook means so as to allow the bottom plate to pivot downwardly, and means operatively thereafter to pivot the bottom plate to a horizontal position thereby closing the bottom of said dehydrating vessel.

2. A dehydrating apparatus for dehydrating materials, comprising:

a dehydrating vessel having a bottom plate;

means for rotating said vessel;

means for opening said bottom plate and discharging dehydrated materials from said vessel;

means pivotally securing said bottom plate to said vessel;

means for allowing said bottom plate to open during rotation of said vessel, said means for allowing the bottom plate to open being operable only at the end of a dehydrating cycle such that during a normal operating cycle the bottom plate remains in a horizontal position closing the bottom of the dehydrating vessel until such time that the cycle is terminated, said means for allowing the bottom plate to open then being actuated to allow the bottom plate to discharge the materials; and means operative thereafter to pivot the bottom plate back to a horizontal position thereby closing the bottom of said dehydrating vessel.

* * * * *